US008240300B1

(12) United States Patent
Wilhelm

(10) Patent No.: US 8,240,300 B1
(45) Date of Patent: Aug. 14, 2012

(54) HOT/COLD PACK PRODUCT AND METHOD OF MAKING

(76) Inventor: Raymond P. Wilhelm, San Francisco, CA (US)

( * ) Notice: Subject to any disclaimer, the term of this patent is extended or adjusted under 35 U.S.C. 154(b) by 0 days.

(21) Appl. No.: 13/068,493

(22) Filed: May 12, 2011

Related U.S. Application Data

(62) Division of application No. 11/888,602, filed on Aug. 1, 2007, now Pat. No. 7,980,242.

(51) Int. Cl.
*F24J 1/00* (2006.01)

(52) U.S. Cl. ..... 126/263.07; 126/263.05

(58) Field of Classification Search ..... 126/263.07, 126/263.05; 53/431, 440, 433; 62/4, 530
See application file for complete search history.

(56) References Cited

U.S. PATENT DOCUMENTS 2,823,665 A * 2/1958 Steinbach ..... 126/263.05
* cited by examiner

*Primary Examiner* — Alfred Basichas
(74) *Attorney, Agent, or Firm* — Thomas R. Lampe

(57) ABSTRACT

A hot/cold pack product including two sheet structures, one of which includes compartments holding dehydrated gel powder and the other of which is an insulating and waterproof sheet structure attached to the first sheet structure. The powder remains dehydrated until water is added by a user.

9 Claims, 5 Drawing Sheets

HOT/COLD PACK PRODUCT AND METHOD OF MAKING

This application is a divisional application based on U.S. patent application Ser. No. 11/888,602, filed Aug. 1, 2007 now U.S. Pat. No. 7,980,242.

TECHNICAL FIELD

This invention relates to a hot/cold pack product and method of making the product.

BACKGROUND OF THE INVENTION

Hot/cold packs have been employed in one form or another for centuries. One of the earliest modern forms of cold pack still in use today is no more than water ice cubes inside a plastic bag. The other example of a well known pack is the hot water bag. These common devices have been known and utilized for over a century.

The traditional hot water/ice bag has to a substantial degree been replaced by the use of high viscosity water based gels instead of ice water, the gels have a suppressed freeze point to maintain flexibility when frozen. Such devices have disadvantages.

Conventional hot/cold gel packs are very heavy and shipping costs are very expensive. Freight charges can exceed the product costs, the further the travel distance the greater the transport costs.

Another disadvantage of gel based approaches is that in order to achieve flexibility manufacturers must add various additives to lower the freezing point of the gel so that it can flexible when frozen. These additives can be common sodium chloride or propylene glycol added to the mostly water based gel. A great deal of effort is spent blending the proper ratios of gel to water to additives to achieve the desired gel freeze suppressant.

A third disadvantage is that modern hot/cold gel packs cannot be placed directly in the microwave to heat the packs.

This can be very dangerous. Modern gel hot/cold packs are contained typically in non-porous wrappers that cannot breathe. If a gel pack is excessively microwaved it can explode. This occurs when the water component is turned to vapor when internal gel temperatures exceed 212 degrees Fahrenheit. The pack will swell as the water turns to steam. Pressure will increase until the wrapper bursts. This is extremely dangerous if the superheated gel comes in contact with the skin.

A fourth disadvantage of modern hot/cold packs is that when they are wholly frozen they can cause frostbite when in direct contact with the skin or can damage products that cannot be subjected to sub zero freezing temperatures. It is believed that virtually every hot/cold gel pack sold today states that one must place a barrier between the pack and skin to prevent frostbite since the surface temperature is well below 32 degrees Fahrenheit.

A fifth disadvantage of all known modern hot/cold packs is that overall thermal performance is decreased due to the addition of freeze suppressing agents. These chemicals lower the freeze point to achieve a flexible gel at temperatures below freezing, however this also decreases the duration of cooling by the pack since the gel never freezes (becomes solid).

A sixth disadvantage of modern hot/cold gel packs is that the entire pack becomes useless if it is punctured or torn. The entire contents of the pack can escape the outer container.

A seventh disadvantage of modern hot/cold gels is that most altered gel structures employed are of a very slippery, slimy or corrosive nature and cannot easily be disposed of. In addition, they can contain harmful substances. These gels are not water soluble.

DISCLOSURE OF INVENTION

The present invention relates to a hot/cold pack product which has numerous advantages over the prior art gel-based hot/cold packs recited above. The product is very light-weight when shipped, weighing as little as 10 percent or less of the weight of standard prehydrated gel packs. This results in considerable freight savings since the main ingredient, water, is added by the end user rather than prior to transport.

The hot/cold pack product of the present invention does not require any special blending or freeze lowering additives to maintain a flexible gel at temperatures below 32 degrees Fahrenheit. In addition, the invention using no freeze suppressing additives results in a much lower cost to produce a flexible gel structure. The flexibility of the invention is achieved by the nature of the seals connecting the segmented hydrated cells containing the frozen gel.

The invention also eliminates the explosive hazard of pressure buildup when the packs are microwaved or otherwise heated to a temperature exceeding 212 degrees Fahrenheit. The water component will turn to a gas and expand and burst conventional non-porous packs. As will be seen below, a porous structure is utilized in the product which will allow gel vapors/pressure to vent out of the product rather than burst.

The flexible hot/cold pack product of the present invention can never reach a temperature sufficiently low to cause damage to the skin or products. There is no need for a barrier to prevent frostbite or freezing of products since the freezing point of the gel is 32 degrees Fahrenheit rather than below 30 degrees Fahrenheit, sometimes well below, as is the case with present gel packs.

The present invention uses pure water as the primary gelling agent. No freeze suppressants are needed with the invention. The structure of the invention will freeze solid at 30 degrees Fahrenheit. A key feature of all conventional gel structures is to be flexible at sub zero temperatures. The hot/cold pack product of this invention will remain flexible even when the gel structure is frozen solid. Flexibility obtained by the seals connecting the segmented gel cells allows the gel to achieve maximum performance since the gel is fully frozen (phased). Using this approach hot/cold pack product of this invention will perform over 50 percent longer than altered gel structures.

Employing the teachings of my invention, a pack if punctured or torn will not cause loss of all of the contents since the preferred approach is to employ a number of compartments or cells. If one cell is punctured, this will not render the entire structure useless. The gel incorporated in this invention does not contain harmful substances and is not slippery, slimy or corrosive. It is water soluble and non-toxic. The addition of salt water to the gel will dissolve it back to water. Conventional gel structures will not.

One of the other key advantages of my invention is that the flexible, segmented gel hot/cold pack product is insulated on one side. This is of great value for numerous reasons. Since that one side is insulated, thermal performance values are increased by over 40 percent. This insulated on one side feature combined with an unaltered pure water gel structure results in the highest thermal performance possible.

The unique flexible insulation addresses two major thermal degrading factors. In a preferred embodiment of the invention the outer structure of the insulation is comprised of metalized or white polyethylene. This produces a shiny outer face that reflects away heat. This is what is known as radiant heat. Conductive heat is also addressed by my invention by use in a preferred embodiment of my invention of air cell bubbles that are trapped between the metalized or white polyethylene and the outer face. By addressing these two ways that external heat attacks the frozen gel, longer cooling or heating durations and better performance result. Another benefit is that the product is comfortable to hold without the product wasting energy or adding heat by holding the pack. The one-sided insulated feature focuses and directs all the energy to the desired area.

Another advantage of the present invention is that the flexible, insulated, segmented hot/cold pack product can be configured to wrap around any object and stay in place. It is a common practice of conventional hot/cold gel pack manufacturers to sell the packs with a holder/wrap of some kind or recommend use of a holder/wrap. These are usually an Ace bandage type or some form of elastic material with a pouch for the hot/cold pack to slip into, a synthetic hook and eye closure material often being utilized. When the pack is used in physical therapy applications, this is useful since one can wrap the pack to the body and still be mobile. In this application, the product of my invention incorporates the hot/cold pack, along with an insulated wrap all in one.

The hot/cold pack product of this invention includes a first sheet structure of multi-laminate construction having an outer wall of water-proof material and having an inner wall connected to the outer wall and extending along at least a portion of the outer wall and defining therewith a plurality of compartments, the inner wall formed of porous material allowing the passage of water therethrough.

Dehydrated gel material is in the compartments.

Insulating and water-proof second sheet structure is attached to the first sheet structure and defines an interior therewith. The compartments face the second sheet structure whereby water introduced into the interior will contact the compartments, pass through the porous material thereof and hydrate the hydrated gel material in the compartment.

The invention also encompasses a method of making a hot/cold pack product. The method includes the step of providing a first sheet structure of multi-laminate construction having an outer wall of water-proof material and an inner wall of porous material, the inner wall and the outer wall defining compartments.

Dehydrated gel material is placed in the compartments. The insulating and water-proof second sheet structure is attached to the first sheet structure to define an interior therebetween, with the compartments facing the second sheet structure.

The method also includes providing an opening between the first sheet structure and the second sheet structure communicating with the interior.

Water is introduced through the opening into the interior to submerse the compartments in the water.

Water in the interior is allowed to enter the compartments through the porous material to hydrate the dehydrated gel material therein.

A search of the prior art located the following United States patents which is believed to be representative of the present state of the prior art: U.S. Pat. No. 5,785,980, issued Jul. 28, 1998.

Other features, advantages and objects of the present invention will become apparent with reference to the following description and accompanying drawings.

MODES FOR CARRYING OUT THE INVENTION

Figure 1:
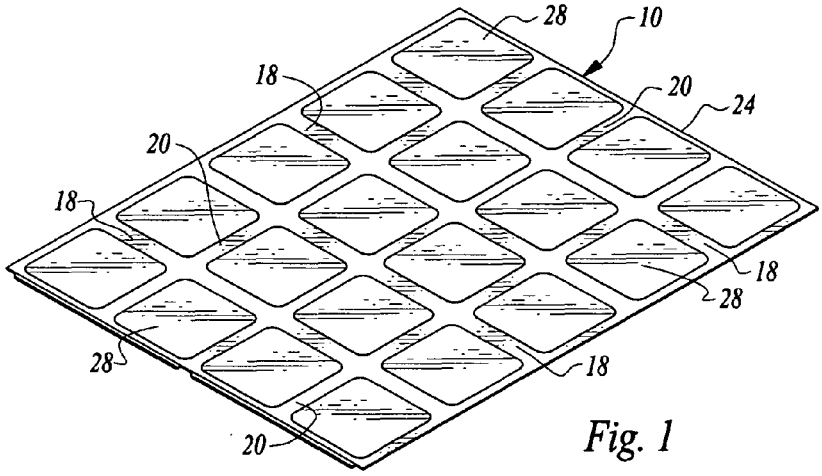
FIG. 1 is a perspective view of a hot/cold pack product constructed in accordance with the teachings of the present invention.
Figure 2:
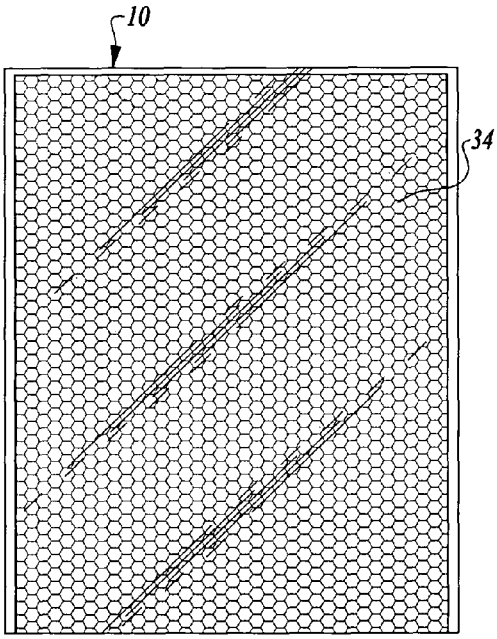
FIG. 2 is a plan view of one side of the hot/cold pack product.
Figure 3:
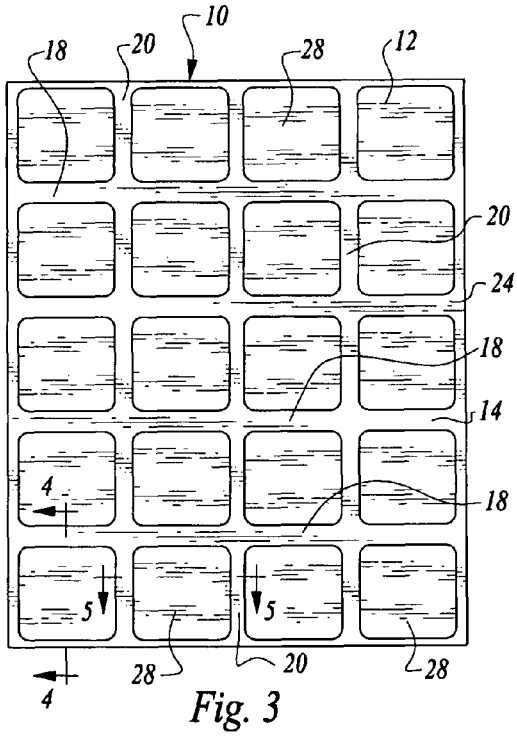
FIG. 3 is a plan view of the other side of the hot/cold pack product.
Figure 4:
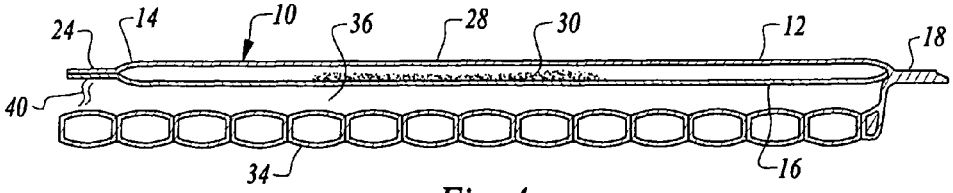
FIG. 4 is a greatly enlarged view of that portion of the hot/cold pack product delineated by line 4-4 in FIG. 3.
Figure 5:
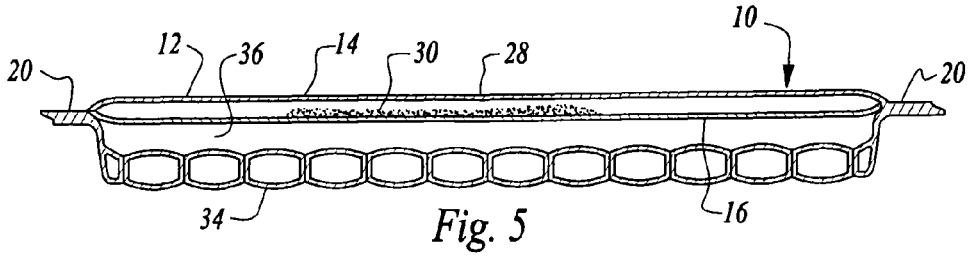
FIG. 5 is a view similar to FIG. 4 taken along the line 5-5 of FIG. 3, showing a dehydrated gel material in one of the compartments of the product.
Figure 6:
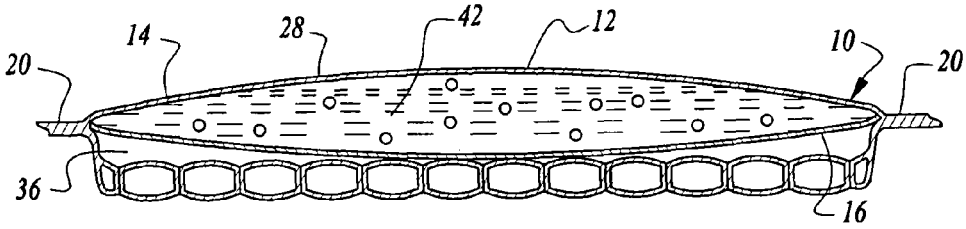
FIG. 6 is a view similar to FIG. 5, but showing the powder hydrated by water to form a gel in the compartment.

FIGS. 1-6, 12 and 13 disclose an embodiment of a hot/cold pack product 10 constructed in accordance with the teachings of the present invention. The product includes a first sheet structure 12 of multi-laminate construction having an outer wall 14 of water-proof material and an inner wall 16 connected to the outer wall and extending therealong. In this embodiment the inner wall and outer wall are co-extensive and in registry.

Preferably, the outer wall is formed of thin, plastic sheeting allowing ready transmission of heat or cold therethrough. The outer wall and inner wall are heat sealed about the entire periphery of the first sheet structure along heat seal edge portions 24.

The outer and inner walls 14, 16 are also heat sealed to provide orthogonally disposed, intersecting heat seal joints 18 and 20 which extend to the outer peripheral heat seal edge portions 24 extending about the outer periphery of the first sheet structure.

Compartments 28 are formed between the outer wall and inner wall between the seal joints and heat seal edge portions. A dehydrated super absorbent gel powder 30, for example polyacrylimide gel powder, is disposed in each of the compartments. Inner wall 16 is formed of porous sheet material, such as a non-woven synthetic, such as nylon, which will allow the passage of water therethrough.

Hot/cold pack product 10 also includes an insulating and water-proof second sheet structure 34 which is attached to the first sheet structure and defines an interior 36 therewith. Second sheet structure 34 comprises sheet material defining air-filled spaces. More specifically, the plastic sheet material is suitably the plastic product commonly known as bubble wrap having a metalized, or white reflective outer surface. The second sheet structure is heat sealed or otherwise affixed at three outer edges thereof to a corresponding three edges of the first sheet structure. The first sheet structure and second sheet structure are not attached at the fourth corresponding edges thereof so that a water ingress and egress opening 40 is formed between the first sheet structure and second sheet structure which communicates with the interior 36. The metalized or white outer surface of the bubble wrap reflects radiant heat.

The hot/cold pack product 10 is shipped with the gel powder 30 in dehydrated condition, greatly lowering transport and storage costs.

The gel powder is hydrated by the end user when use of the hot/cold pack product is desired. This is readily and simply accomplished. Plain water is poured into interior 36 through opening 40. The water passes through the porous inner wall 16 and engages the powder. This results in formation of a hot/cold pack gel 42 in the compartments 28, as shown for example in FIG. 6. After formation of the gel, excess water in the interior 36 may simply be poured therefrom.

The gel is then frozen if the product is to be used as a cold pack or heated if it is to be employed as a hot pack. The product when employed as a cold pack may be readily bent about the seal joints 18 even when the gel is frozen hard.

Figure 12:
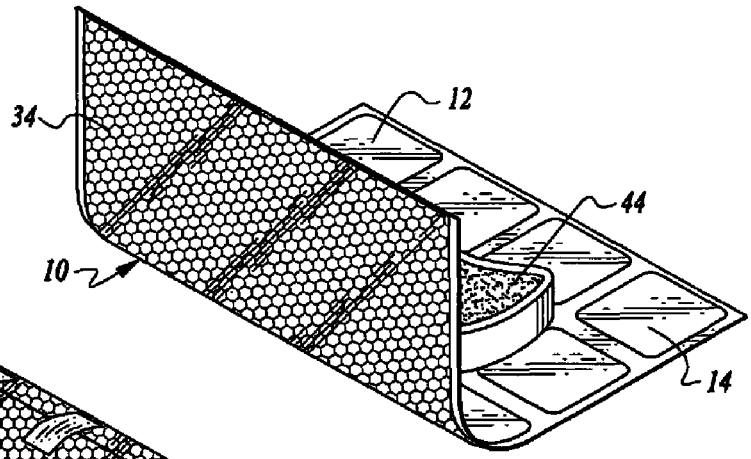
FIG. 12 shows the hot/cold pack product embodiment of FIG. 1 in the process of wrapping a piece of meat.
Figure 13:
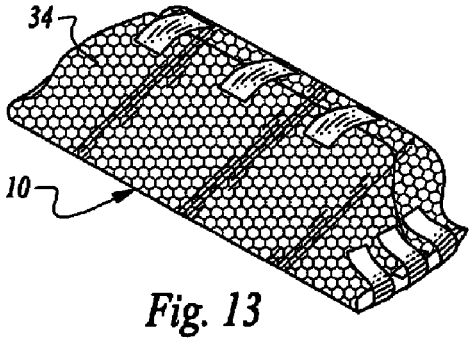
FIG. 13 shows the hot/cold pack product embodiment of FIG. 1 wrapped about the meat and secured in place, conforming to the shape of the meat.

FIG. 12 shows the product 10 being utilized as a cold pack. In this instance, a piece of meat 44 is wrapped in product 10 to keep it cold. It is important to note that the meat is surrounded and engaged by outer wall 14 of first sheet structure 12. The insulating and water-proof second sheet structure 34 is disposed outwardly. The thin outer wall 14 allows transfer of cold from compartments 28 and the second sheet structure effectively insulates the meat from ambient heat. When the outer surface of the second sheet structure is metalized or white and heat reflective, insulation is even more effective. FIG. 13 shows the hot/cold pack product 10 completely wrapped about the meat and secured in place by adhesive tapes to provide a secure package.

Figure 7:
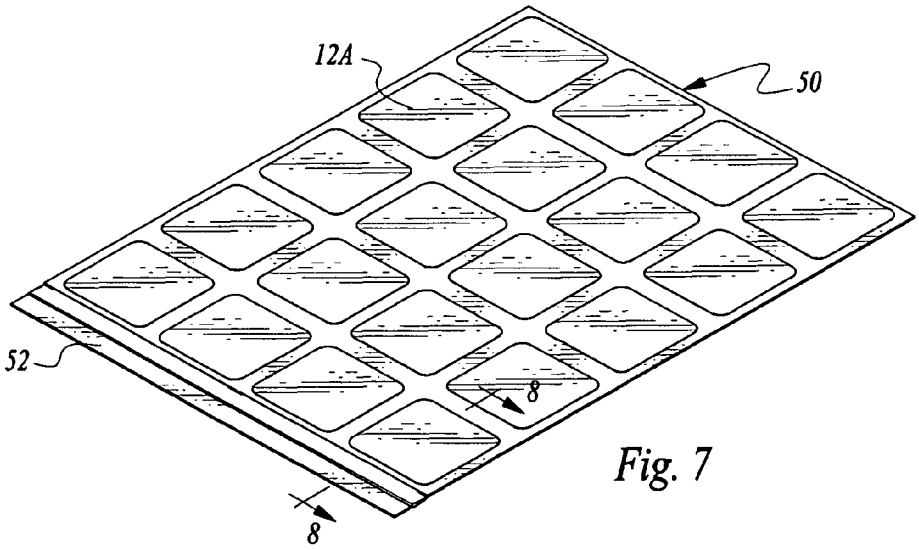
FIG. 7 is a perspective view of an alternative embodiment of the invention.
Figure 8:
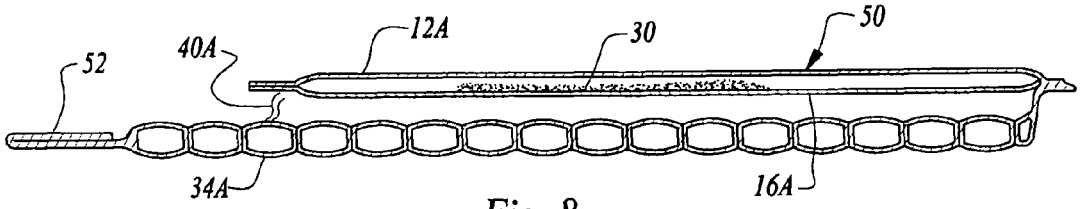
FIG. 8 is a view taken along line 8-8 in FIG. 7 and illustrating a compartment containing dehydrated gel material.

FIGS. 7 and 8 show an alternative form of hot/cold pack product 50 which is similar to above described hot/cold pack product 10. In this arrangement, however, the second sheet structure 34A is somewhat longer than first sheet structure 12A so that an end of the second sheet structure extends beyond opening 40A. The distal end 52 of the second sheet structure is doubled over to provide a handle for the user.

Figure 9:
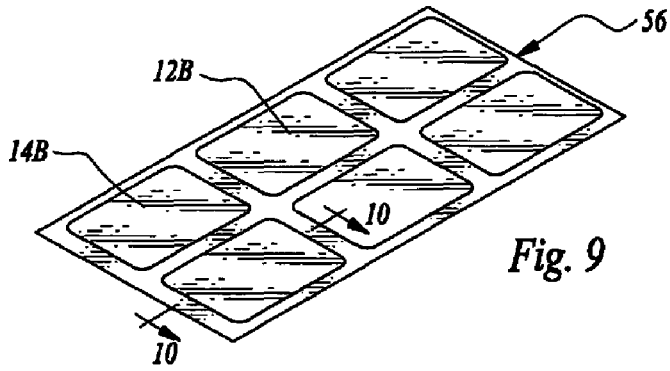
FIG. 9 is a perspective view of a third embodiment of the invention.
Figure 10:
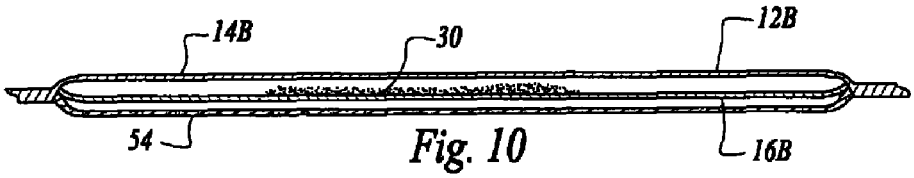
FIG. 10 is an enlarged cross-sectional view taken along line 10-10 in FIG. 9 and illustrating a compartment containing dehydrated gel powder in the compartment.
Figure 11:
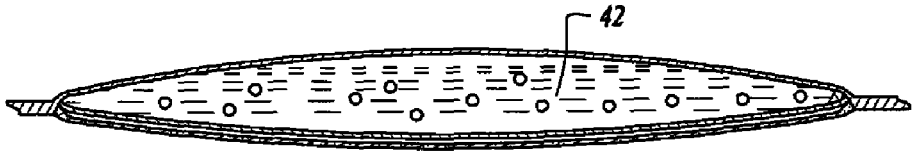
FIG. 11 is a view similar to FIG. 10, but showing the gel in the compartment produced by water introduced into the compartment and hydrating the dehydrated gel material.

FIGS. 9-11 illustrate another embodiment of the invention, hot/cold pack product 56, wherein the second sheet structure 54 is not formed of bubble wrap, but rather a sheet of some other type of insulating material such as closed cell foam sheeting. FIG. 10 discloses the condition of this embodiment prior to hydration of the powder and FIG. 11 shows the condition of the structure after gel 42 has been formed by addition of water.

Figure 14:
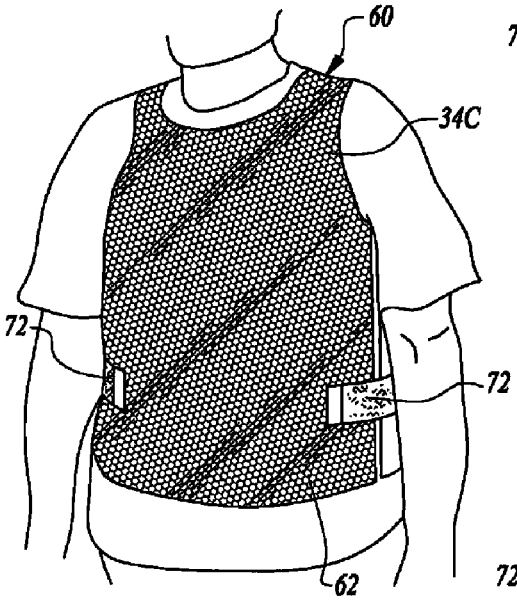
FIG. 14 is a perspective view of another embodiment of the invention wherein the hot/cold pack product is a vest being worn by an individual.
Figure 15:
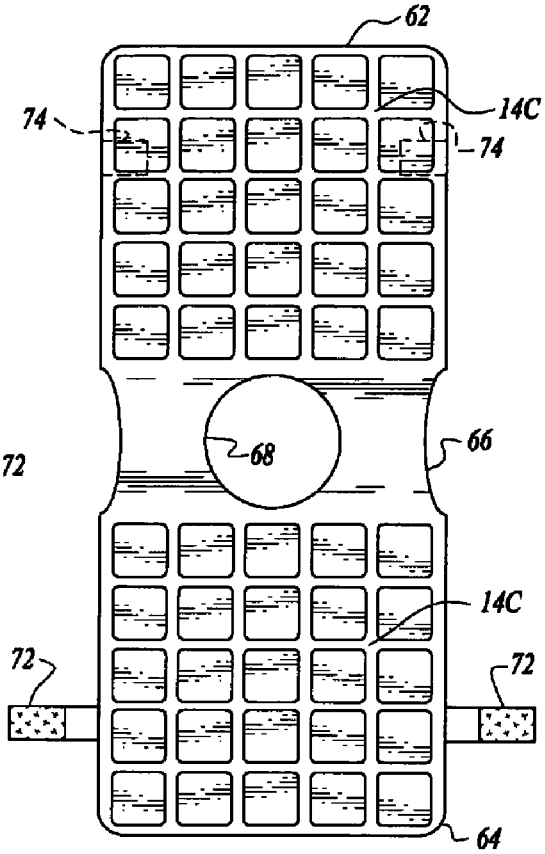
FIG. 15 is a plan view of the vest.

FIGS. 14 and 15 disclose an embodiment of the invention wherein the hot/cold pack product is in the form of a vest 60.

The vest 60 includes two vest segments 62, 64 interconnected by a shoulder engagement portion 66 having a hole for accommodating a wearer's neck. The vest is worn with the outer surface of second sheet structure 34C disposed outwardly and the outer wall 14C of the first sheet structure 12C facing the wearer's body. The vest segments are secured together by any suitable connectors such as components 72, 74 of a conventional hook/eye synthetic connector material.

Figure 18:
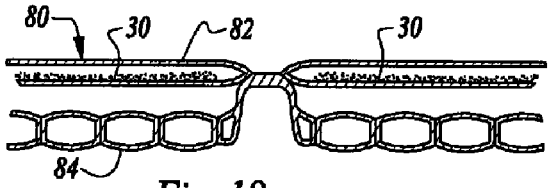
FIG. 18 is an enlarged, cross-sectional view taken along the line 18-18 in FIG. 17.
Figure 16:
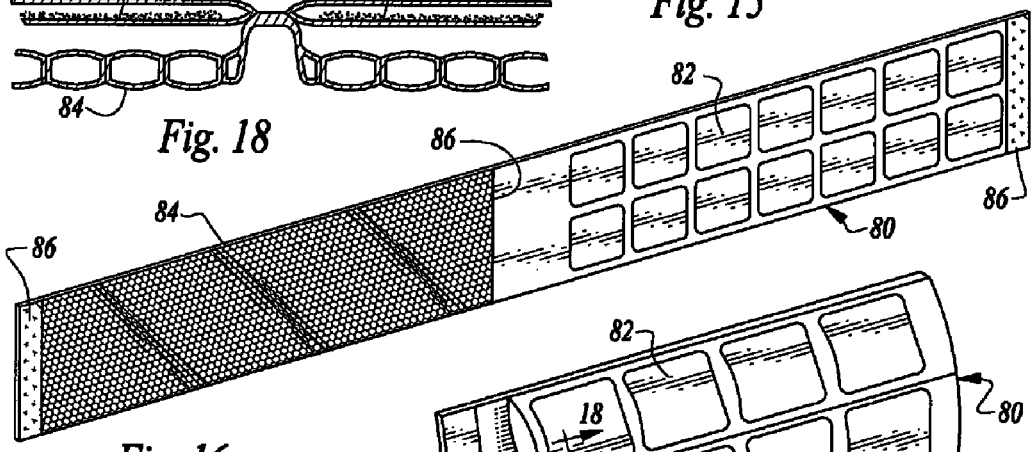
FIG. 16 is a perspective view of yet another embodiment of the invention with the two sheet structures thereof unsecured and in alignment.
Figure 17:
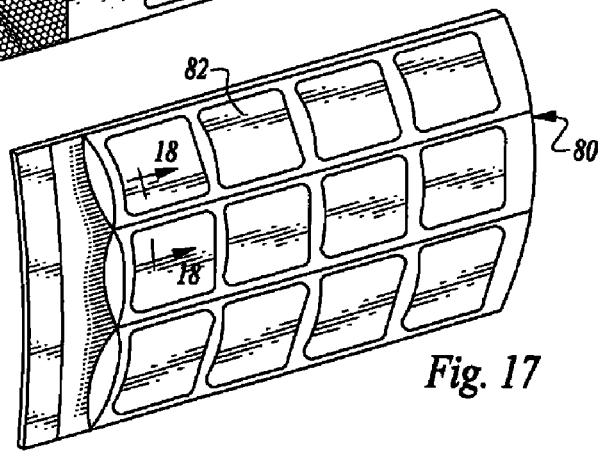
FIG. 17 is a perspective view showing the sheet structures of the embodiment of FIG. 16 secured together.

FIGS. 16-18 disclose another embodiment of the invention, hot/cold pack product 80. In this arrangement first sheet structure 82 and second sheet structure 84 are disposed end to end, being connected along a fold line 86. Prior to use, the first sheet structure 82 and second sheet structure 84 are brought into face-to-face relationship as shown in FIG. 17 and secured in that configuration by end strips 86 which may for example be adhesive strips or strips of synthetic hook and eye connector material.

Figures 19, 20, 21, 22:
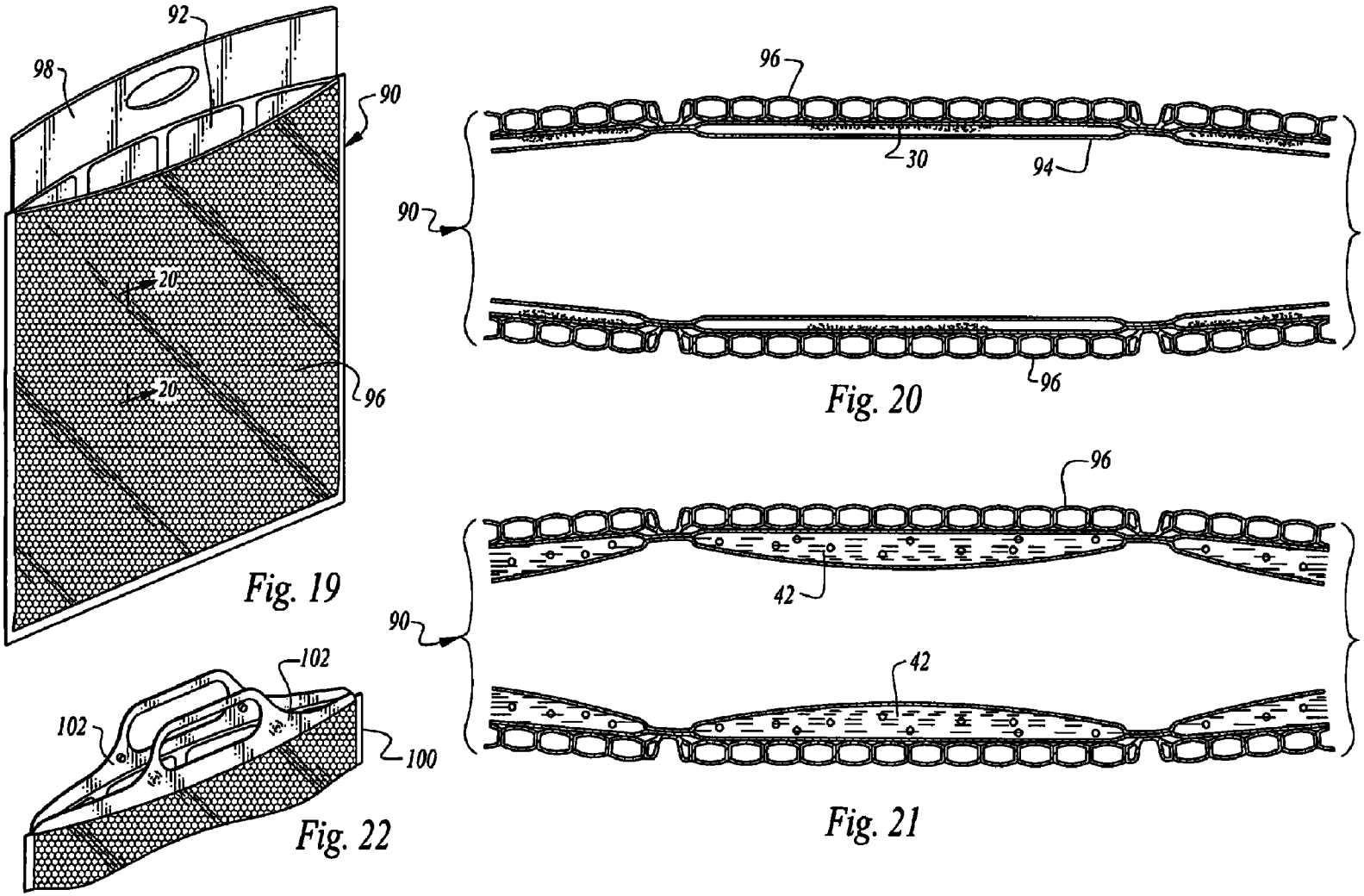
FIG. 19 shows another embodiment of the invention including a support.
FIG. 20 is an enlarged, cross-sectional view taken along line 20-20 in FIG. 19 and showing adjacent compartments of adjacent sheet structures of the embodiment of FIG. 19 with dehydrated gel powder therein.
FIG. 21 is a view similar to FIG. 20, but illustrating the powder hydrated by water to form a gel in the compartments.
FIG. 22 is a perspective view of the top portion of another embodiment of the hot/cold pack product of this invention.

FIGS. 19-21 illustrate an embodiment alternative of a hot/cold pack product in the form of a bag 90 having an opening 92. The two sides of the bag are of identical construction, each comprising a laminate including a first sheet structure 94 defining compartments holding dehydrated gel powder 30 disposed inwardly and second sheet structure 96 bonded to the first sheet structure and disposed outwardly. A support flap 98 extends upwardly from opening 92 having a hole therein which may be utilized to carry or support the product 90. FIG. 20 shows the dehydrated gel powder before contact with water and FIG. 21 shows the powder hydrated to form a gel 42. FIG. 22 illustrates an embodiment 100 similar to the embodiment of FIGS. 19-21 except that two carrier handles 102 extend upwardly from the opening from both sides of the bag.

The method of making a hot/cold pack product in accordance with the teachings of the present invention includes the step of providing a first sheet structure of multi-laminate construction having an outer wall of water-proof material and an inner wall of porous material, the inner wall and the outer wall defining compartments.

Dehydrated gel material is placed in the compartments. An insulating and water-proof second sheet structure is attached to the first sheet structure to define an interior therebetween, with the compartments facing the second sheet structure.

An opening is provided between the first sheet structure and the second sheet structure communicating with the interior. Water is introduced through the opening into the interior to submerse the compartments in water. The water in the interior is allowed to enter the compartments through the porous material and hydrate the dehydrated gel material therein.

After the step of hydrating the dehydrated gel material, excess water is removed from the interior.

According to the method, a plurality of sealed separate compartments are formed by the inner wall and the outer wall, the inner wall and the outer wall being heat sealed about the plurality of compartments.

Bendable seal joints are formed about the compartments during the step of heat sealing.

The method also includes providing a support adjacent to the opening to support the attached first and second sheet structures with the opening elevated relative to the interior for a period of time after water has been introduced into the interior.

The invention claimed is:

1. A hot/cold pack product comprising, in combination:

first sheet structure of multi-laminate construction including an outer wall of water-proof material allowing ready transmission of heat or cold therethrough and an inner wall formed of porous material allowing the passage of water therethrough sealed to said outer wall and extending along at least a portion of said outer wall, said outer wall of water-proof material and said inner wall of porous sheet material being in face-to-face relationship and defining a plurality of compartments, and said outer wall of water-proof sheet material and said inner wall of porous sheet material sealed together and forming a peripheral seal extending entirely about said plurality of compartments and extending entirely about each compartment of said plurality of compartments, and said outer wall of water-proof sheet material being continuous and free of openings at said compartments whereby liquid cannot flow either into or out of said compartments through said outer wall of water-proof sheet material;

dehydrated gel material in said compartments; and insulating and water-proof second sheet structure attached to said first sheet structure and defining an interior therebetween and a water ingress opening communicating with the interior for introducing water into the interior, with said inner wall of porous sheet material and said compartments facing said second sheet structure whereby water introduced into said interior through said water ingress opening will contact said compartments, pass through the porous material thereof and hydrate the dehydrated gel material in the compartments without passing through said outer wall of water-proof sheet material.

2. The hot/cold pack product according to claim 1 wherein said second sheet structure comprises sheet material defining air-filled spaces.

3. The hot/cold pack product according to claim 2 wherein said sheet material at least partially comprises plastic sheet material.

4. The hot/cold pack product according to claim 3 wherein said plastic sheet material has a metalized or white outwardly disposed heat reflecting surface.

5. The hot/cold pack product according to claim 3 wherein the plastic sheet material is bubble wrap.

6. The hot/cold pack product according to claim 1 wherein said dehydrated gel material comprises a dehydrated super absorbent gel powder.

7. The hot/cold pack product according to claim 6 wherein said dehydrated superabsorbent gel powder is polyacrylimide.

8. The hot/cold pack product according to Claim 1 additionally comprising at least one support adjacent to said water ingress opening for supporting said hot/cold pack product with said water ingress opening disposed above said interior.

9. The hot/cold pack product according to claim 1 wherein said porous material comprises a non-woven material.

* * * * *